US007393238B2

(12) United States Patent
Xuan et al.

(10) Patent No.: US 7,393,238 B2
(45) Date of Patent: Jul. 1, 2008

(54) MODULAR JACK WITH LED RETENTION MEANS

(75) Inventors: Wan-Li Xuan, Kunshan (CN); Qing Wan, Kunshan (CN); Li-Chun Wu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/888,462

(22) Filed: Aug. 1, 2007

(65) Prior Publication Data

US 2008/0032546 A1 Feb. 7, 2008

(30) Foreign Application Priority Data

Aug. 1, 2006 (JP) ..... 2006 2 0076137

(51) Int. Cl.
*H01R 3/00* (2006.01)

(52) U.S. Cl. ..... 439/490

(58) Field of Classification Search ..... 439/490
See application file for complete search history.

(56) References Cited

U.S. PATENT DOCUMENTS 6,217,371 B1 * 4/2001 Wu ..... 439/490
6,457,993 B1 * 10/2002 Espenshade ..... 439/490
6,478,610 B1 * 11/2002 Zhou et al. ..... 439/490
6,913,481 B2 7/2005 Marshall et al.

* cited by examiner

*Primary Examiner*—Tho D. Ta
(74) *Attorney, Agent, or Firm*—Wei Te Chung

(57) ABSTRACT

A modular jack (100) includes a number of visual indicators (40), an insulative housing (10) having a pair of receiving spaces (11, 12), a number of retention sections (101) for engaging with the visual indicators and a terminal module (20). The retention section defines an opening, a rear wall (16), a bottom wall (14), a pair of side walls (17), a cantilevered arm (15) including a top surface (151) and a wedge-shaped bottom surface (152). The top surface has a second ramp (155) extending forwardly and downwardly. The bottom surface has a contacting portion (153) for resisting against the visual indicator and a first ramp (154) rearwardly upwardly extending from the contacting portion.

10 Claims, 5 Drawing Sheets

MODULAR JACK WITH LED RETENTION MEANS

BACKGROUND OF THE INVENTION

1. Field of the Invention

The present invention relates to a modular jack, and particularly to a modular jack having a retention means for firmly retaining a light emitting diode (LED).

2. Description of Prior Arts

U.S. Pat. No. 6,913,481 issued on Jul. 5, 2005 discloses a modular jack adapted for receiving a plug. The modular jack includes a visual indicator such as LED for indicating a condition of an electrical signal and a body portion defining a pocket for receiving the visual indicator. The pocket has a top wall, a pair of lateral walls, an opening portion and a plurality of ribs formed on the lateral walls for interfering with the corresponding LED. The resulting interference between the ribs and the LED can retain the LED in the pocket.

However, the LED is retained in the pocket only by the interference between the ribs and the LED, without any flexible engagement. Therefore, it is difficult to insert and pull out the LED, and the LED is easy to be broken.

Hence, it is desirable to provide an improved modular jack to overcome the aforementioned disadvantages.

SUMMARY OF THE INVENTION

An object of the present invention is to provide a modular jack having a retention means defining a plurality of cavities for easily inserting and pulling out of a visual indicator and also fastening the visual indicator firmly.

To achieve the above object, a modular jack for receiving a plurality of mating connectors comprises a visual indicator for indicating a condition of an electrical signal, an insulative housing having a receiving space, a retention section for engaging with the visual indicator and a terminal module received in the receiving space for electrically connecting with the mating connector. The retention section defines an opening, a rear wall, a bottom wall, a pair of side walls, a cantilevered arm and a cavity defined therebetween. The cantilevered arm extends obliquely and forwardly from the rear wall for fastening the visual indicator. The cantilevered arm comprises an oblique top surface and a wedge-shaped bottom surface. The top surface has a second ramp extending forwardly downwardly. The wedged-shaped bottom surface has a contacting portion for resisting against the visual indicator and a first ramp rearwardly upwardly extending from the contacting portion.

Advantages of the present invention are to provide a retention section comprising a cantilevered arm extending obliquely from the rear wall for fastening the visual indicator. With this configuration, the contacting portion is resisting against the visual indicator firmly and providing flexible force for the visual indicator. Therefore, it is easy to insert and pull out of the visual indicator. The visual indicator can also be firmly fastened.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
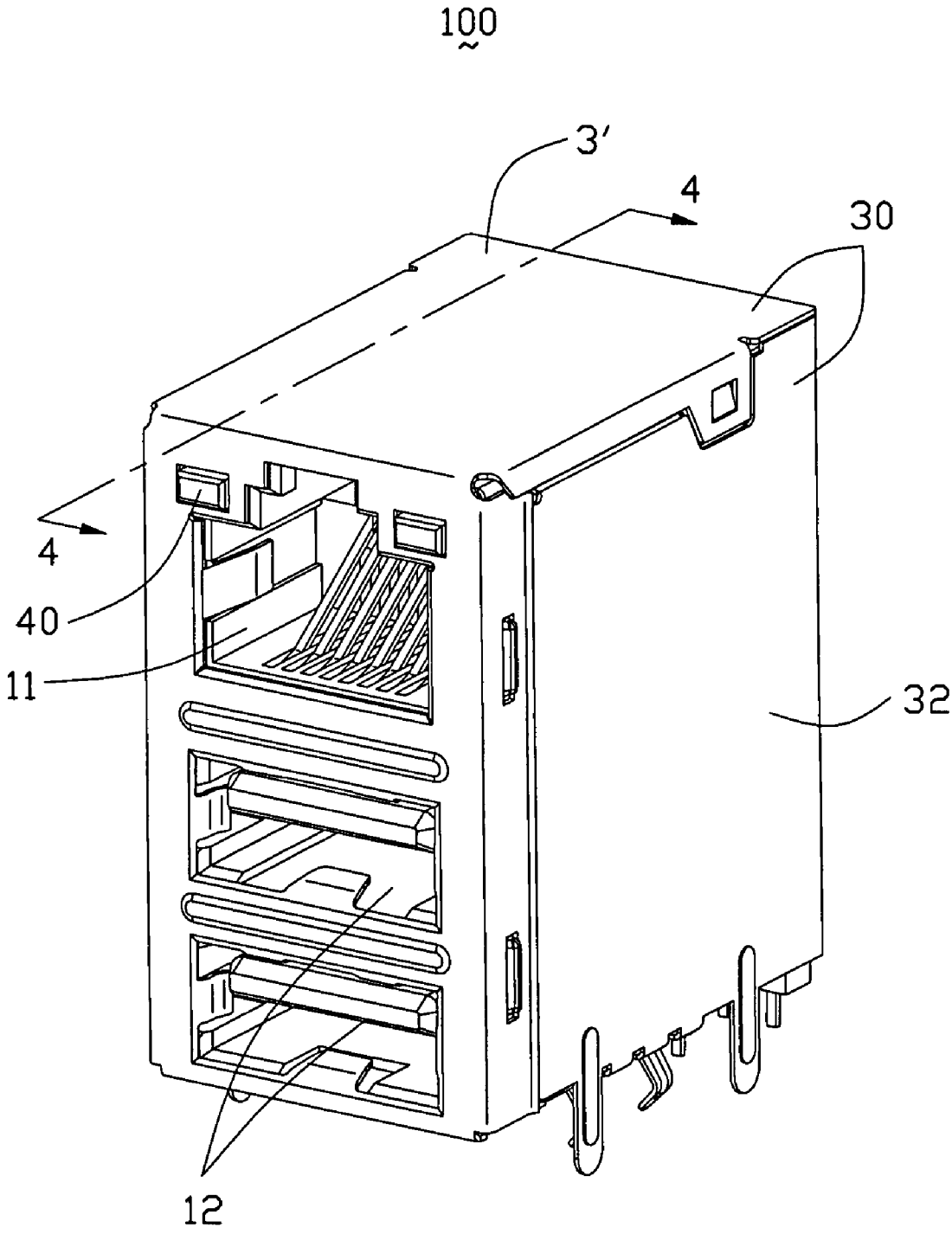
FIG. 1 is an assembled perspective view of a modular jack according to the present invention.
Figure 2:
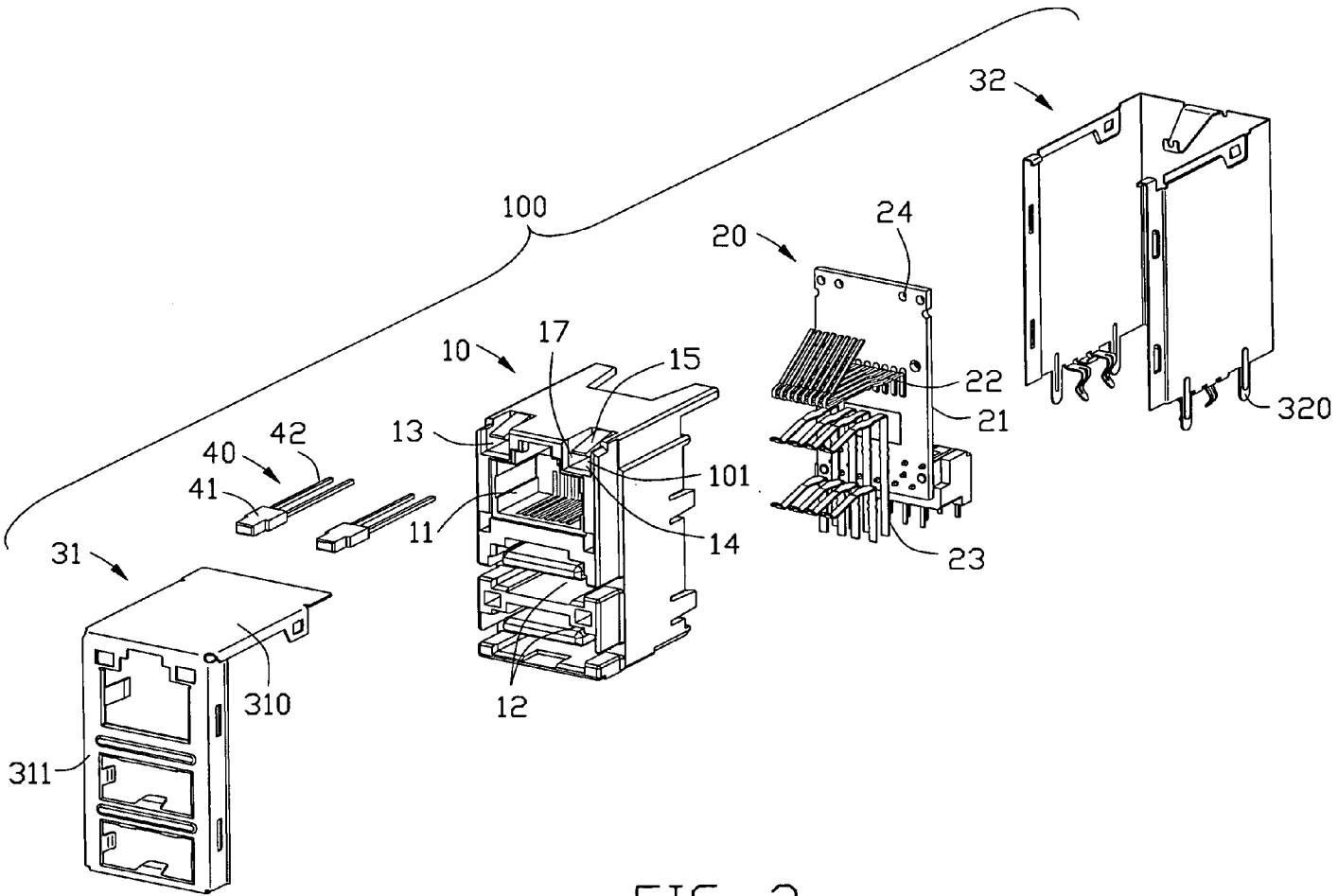
FIG. 2 is an exploded view of the modular jack as shown in FIG. 1.
Figure 3:
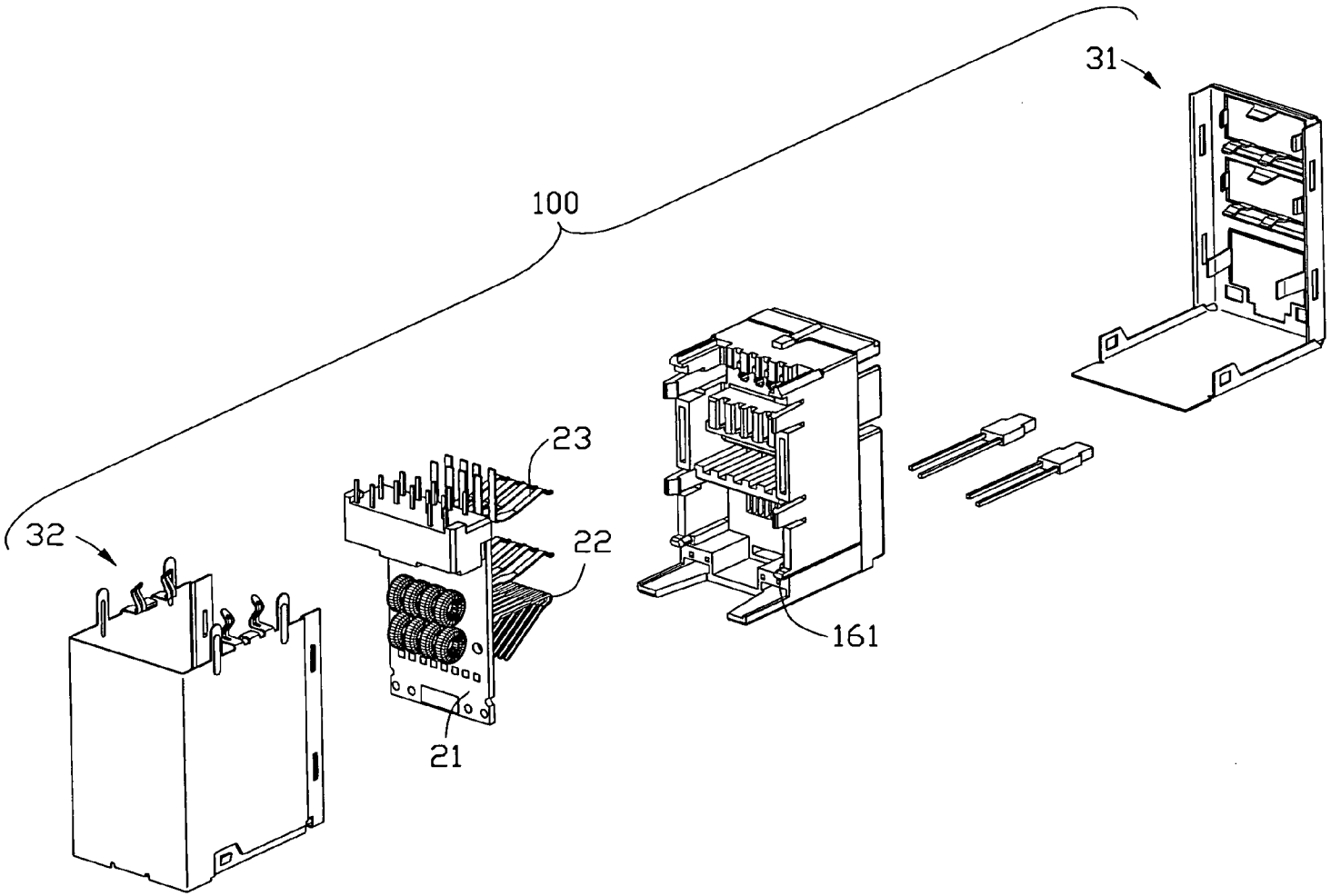
FIG. 3 is another exploded view similar to FIG. 1, taken from another aspect.

Reference will now be made to the drawing figures to describe the present invention in detail. Referring to FIGS. 1-5, a stacked modular jack 100 adapted for receiving three plugs (not shown) in accordance with the present invention comprises an insulative housing 10, a terminal module 20, a conductive outer shield 30 enclosing the insulative housing 1 and a pair of visual indicators 40.

Figure 4:
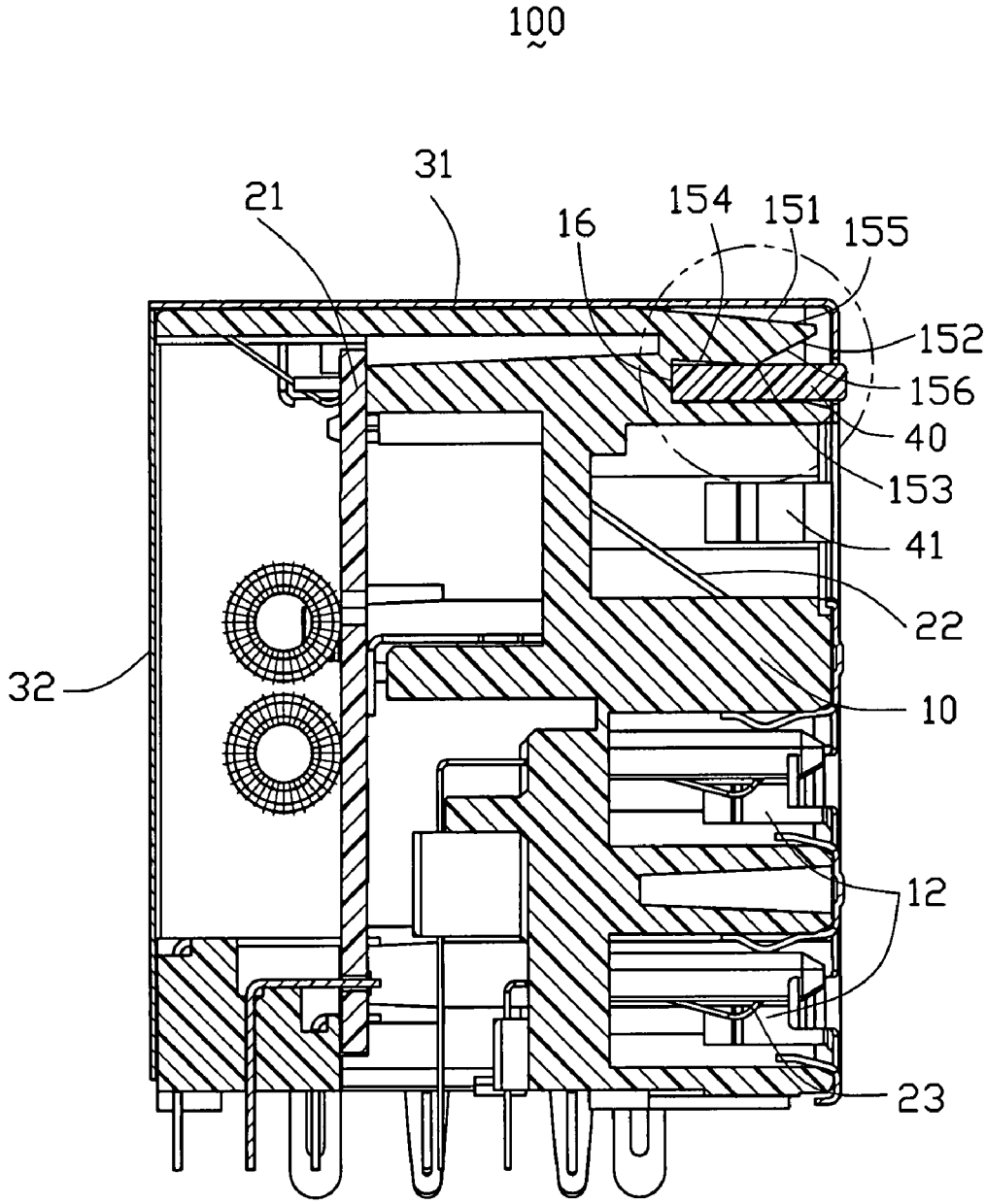
FIG. 4 is a sectional view of the modular jack taken along line 4-4 of FIG 1.
Figure 5:
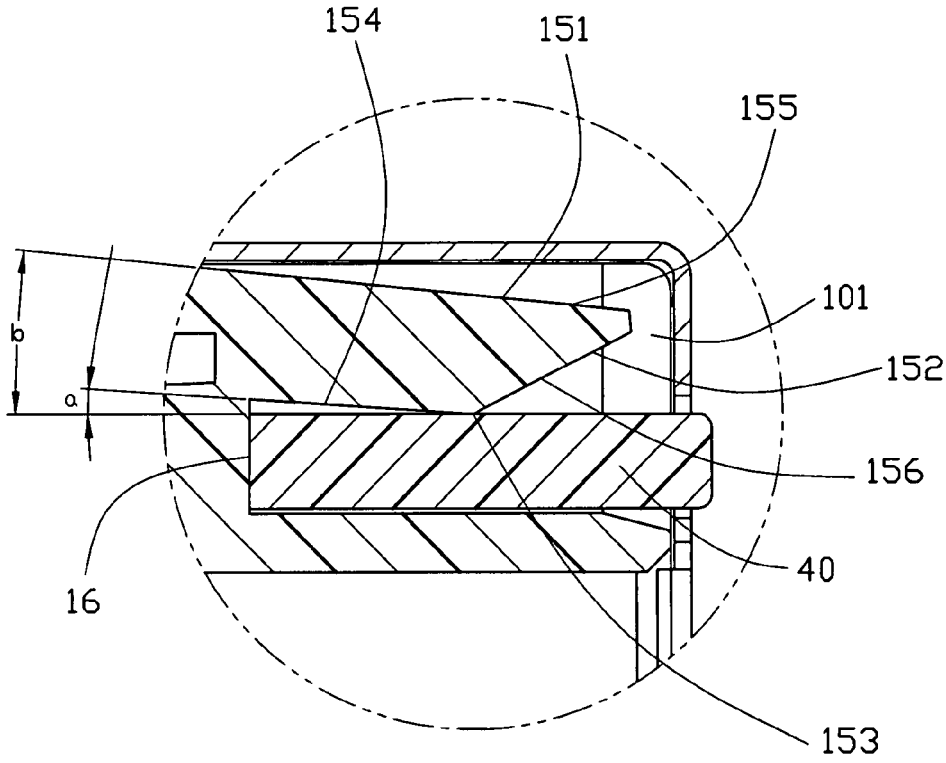
FIG. 5 is a magnifying view of a retention section, as especially labeled in the FIG. 4.

Referring to FIGS. 2-5, the insulative housing 10 includes a first receiving space 11 for receiving a RJ-plug connector (not shown), a second and third receiving spaces 12 adjacent to the first receiving space 11 for receiving Universal Serial Bus (USB) plugs (not shown) and a pair of retention sections 101 symmetrically defined above the first receiving space 11 for engaging with the visual indicators 40. The retention section 101 has an opening (not labeled), a rear wall 16, a cantilevered arm 15 extending from the rear wall 16, a bottom wall 14, a pair of side walls 17 and a cavity 13 defined therebetween. The cantilevered arm 15 has an oblique top surface 151 and a wedge-shaped bottom surface 152 facing to the bottom wall 14. The bottom surface 152 comprises a contacting portion 153 for firmly resisting against the visual indicator 40, a first ramp 154 rearwardly obliquely extending from the contacting portion 153 and forming an angle "a" relative to the bottom wall 14, and a guiding face 156 forwardly obliquely extending from the contacting portion 153. The top surface 151 has a second ramp 155 extending forwardly downwardly to the opening and forming an angle "b" relative to the bottom wall 14. The angle "a" is smaller than or equal to the angle "b" so that the top surface 151 will not contact the conductive outer shield 30 when the visual indicator 40 is pulled out. FIGS. 4 and 5 are sectional views of the retention section 101 when the visual indicators 40 is inserted.

The terminal module 20 comprises a print circuit board 21, a plurality of first terminals 22 mounted to the print circuit board 21 and received in the first receiving space 11 for electrically connecting with the RJ-plug connector, and a plurality of second terminals 23 received in the receiving spaces 12 for electrically connecting with the USB plugs.

The conductive outer shield 30 has a front conductive outer shield 31 and a rear conductive outer shield 32. The front conducive shield 31 has a top plate 310 covering a top surface of the insulative housing 10 and a second plate 311 bending perpendicularly from the top plate 310 for engaging with a front face of the insulative housing 10. The rear conductive outer shield 32 encloses a pair of side surfaces and a rear surface of the insulative housing 10 and has a plurality of grounding pins 320 extending downwardly.

The visual indicator 40 comprises a housing body 41 for disposing a LED and a pair of connecting terminals 42 extending from the housing body 41. The connecting terminal 42 engages with a corresponding hole 24 disposed on the print circuit board 21.

In assembling, firstly, the terminal module 20 is mounted to the rear face of the insulative housing 10. At that time, the first terminals 22 and the second terminals 23 are respectively received in the receiving spaces 11 and 12. Secondly, the visual indicators 40 are inserted into the cavities 13 via the guiding faces 156. The housing body 41 is resisted against by the contacting portion 153 of the first ramp 154 and then the cantilevered arm 15 is upwardly flexibly moved by the housing body 41 so that the visual indicator 40 is firmly fastened. At the same time, the ends of connecting terminals 42 are connected to the print circuit board 21 through the corresponding holes 24 of the printed circuit board 21. Finally, the front conductive outer shield 31 and the rear conductive outer shield 32 enclose the insulative housing 10.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack for receiving a mating connector, comprising:

a visual indicator for indicating a condition of an electrical signal;

an insulative housing having a receiving space for receiving the corresponding mating connector and a retention section for engaging with the visual indicator, said retention section defining an opening, a rear wall, a bottom wall, a pair of side walls and a cantilevered arm, the cantilevered arm extending forwardly and obliquely from the rear wall and comprising a wedge-shaped bottom surface and a top surface, the wedge-shaped bottom surface having a contacting portion for resisting against the visual indicator and a first ramp rearwardly upwardly extending from the contacting portion, the top surface having a second ramp extending forwardly and downwardly; and a terminal module received in the receiving space for electrically connecting with the mating connector.

2. The modular jack as claimed in claim 1, wherein said bottom surface of the cantilevered arm has a guiding face forwardly upwardly extending from the contacting portion.

3. The modular jack as claimed in claim 1, further comprising a conductive outer shield enclosing the insulative housing.

4. The modular jack as claimed in claim 1, further comprising a cavity defined between the rear wall, the bottom wall, the pair of side walls and the cantilevered arm.

5. The modular jack as claimed in claim 4, wherein said visual indicator comprises a housing body received in the cavity and fastened by the contacting portion of the cantilevered arm and a pair of connecting terminals extending from the housing body.

6. The modular jack as claimed in claim 4, wherein said first ramp of the bottom surface is formed with an angle "a" relative to the bottom wall, said second ramp is formed with an angle "b" relative the bottom wall.

7. The modular jack as claimed in claim 6 wherein said angle "a" has a degree smaller than that of the angle "b".

8. The modular jack as claimed in claim 6, wherein said angle "a" has a degree equal to that of the angle "b".

9. The modular jack as claimed in claim 1, wherein said receiving space comprises a first receiving space for receiving a RJ-plug connector of the plurality of mating connectors and a second receiving space adjacent to the first receiving space for receiving a Universal Serial Bus (USB) plug.

10. The modular jack as claimed in claim 9, wherein said terminal module comprises a print circuit board, a plurality of first terminals mounted to the print circuit board and received in the first receiving space for electrically connecting with the RJ-plug connector, and a plurality of second contacts received in the second receiving space for electrically connecting with the USB plug.

* * * * *